US008550701B2

(12) United States Patent
Kury et al.

(10) Patent No.: US 8,550,701 B2
(45) Date of Patent: Oct. 8, 2013

(54) MECHANICAL WATCH HAVING CONSTANT SPRING FORCE

(75) Inventors: Patrick Kury, Langendorf (CH); Stephan Kussmaul, Buren an der Aare (CH)

(73) Assignee: Eterna AG Uhrenfabrik, Grenchen (CH)

( * ) Notice: Subject to any disclaimer, the term of this patent is extended or adjusted under 35 U.S.C. 154(b) by 702 days.

(21) Appl. No.: 12/741,506

(22) PCT Filed: Oct. 22, 2008

(86) PCT No.: PCT/CH2008/000446

§ 371 (c)(1),
(2), (4) Date: Jun. 18, 2010

(87) PCT Pub. No.: WO2009/059441

PCT Pub. Date: May 14, 2009

(65) Prior Publication Data

US 2010/0254229 A1 Oct. 7, 2010

(30) Foreign Application Priority Data

Nov. 9, 2007 (CH) ..... 1737/07

(51) Int. Cl.
*G04B 5/02* (2006.01)

(52) U.S. Cl.
USPC ..... 368/208; 368/206; 368/148

(58) Field of Classification Search
USPC ..... 368/208, 207, 206, 147, 148
See application file for complete search history.

(56) References Cited

U.S. PATENT DOCUMENTS

| | | | | |
|---|---|---|---|---|
| 7,350,966 | B2 | 4/2008 | Zaugg | |
| 7,473,027 | B2 | 1/2009 | Goeller | |
| 2006/0221775 | A1 * | 10/2006 | Zaugg | 368/127 |

FOREIGN PATENT DOCUMENTS

| | | |
|---|---|---|
| DE | 317294 | 12/1919 |
| EP | 1708048 A1 | 10/2006 |
| EP | 1772783 A1 | 4/2007 |

* cited by examiner

*Primary Examiner* — Renee Luebke
*Assistant Examiner* — Jason Collins
(74) *Attorney, Agent, or Firm* — The Webb Law Firm

(57) ABSTRACT

A mechanical watch comprises a motive spring in a first spring barrel and a mechanical and/or automatic winding device. A second spring barrel and a differential having three drive trains are provided, wherein the train connected to the winding device acts on the first and second spring barrels in the same direction.

20 Claims, 5 Drawing Sheets

MECHANICAL WATCH HAVING CONSTANT SPRING FORCE

TECHNICAL SCOPE OF THE INVENTION

The invention relates to the area of mechanical wristwatches, in particular with automatic winding, where a motive spring in a spring barrel is windable by means of the movements of a wearer through an oscillating weight, the motive spring having as constant a spring force as possible.

PRIOR ART

Such watches are known. A so-called stackfreed or a screw with a radially increasing diameter or also a so-called Maltese cross is used. Said systems are complicated and have their mechanical disadvantages, in particular, they cannot efficiently guarantee the constant spring force.

In the case of automatic watches there is an added problem. In many cases today a rotor system is used, the axis of rotation of which is situated in the center of the movement and which is able to rotate without limitation. The force is transferred to the motive spring by means of reduction gearing. In this case, a brake spring prevents the motive spring becoming overtensioned. The brake spring is a slip clutch that limits the torque of the watch when fully wound.

However, when the movement is fully wound, the torque is not held constant by means of said slip clutch, rather it is reduced abruptly when it slips through and is then increased again by the winding means during the movement of the wearer until it slips through again at the predetermined threshold of the slip clutch. This is achieved by said spring not being suspended fixedly in the spring barrel wall. Between spring barrel and spring end there is a short, powerful spring, the so-called brake spring, which shortly before the fully wound state, sliding along the spring barrel wall under tension, slides from one so-called encoche into another and consequently entrains the tension spring. The brake spring is the slip clutch in order to prevent damage to the tension spring.

This immediately leads to the conclusion that in a wound wristwatch of the prior art with automatic winding the torque is not constant, but rather, in each case, alters in a sawtooth curve up to a threshold.

In addition, even in a watch that is not fully wound that is not being worn, for example, the torque is not constant but is reduced over time. In this respect this problem still exists even in wristwatches with manual winding.

SUMMARY OF THE INVENTION

Proceeding from said prior art, it is the object of the invention to provide a watch of the aformentioned type, where a substantially constant maximum torque is available over a longer period.

A further objective is that the watch is also adjustable in order to make a minimum torque available to achieve improved accuracy. In other words, as soon as it is ascertained that the set minimum torque is no longer guaranteed, the watch will stop.

Another objective is to extend the lifetime with substantially constant torque.

Finally, in particular in the case of automatic watches, steps are taken to avoid the impacts caused by using the slip clutch.

This object is achieved according to the invention for a watch of the aforementioned type with the characteristic features of claim 1.

The mechanical wristwatch according to the invention has a motive spring in a first spring barrel and a mechanical and/or automatic winding device. In addition, a second spring barrel and a differential with three power trains are now provided. By the train connected to the winding means acting on the first and the second spring barrel in the same direction, the two spring barrels are wound in a torque-neutral manner. If the train connected to the winding means stops, in contrast an unwinding of the first spring barrel can be compensated by an application of energy from the second spring barrel via the differential. In particular, the advantageously stronger second spring barrel can then wind-on and/or support the first spring barrel.

Further advantageous embodiments are characterized in the sub claims.

BRIEF DESCRIPTION OF THE DRAWINGS

The invention is described below with regard to advantageous exemplary embodiments with reference to the accompanying drawings, in which, in detail.

DETAILED DESCRIPTION OF EXEMPLARY EMBODIMENTS

Figure 1:
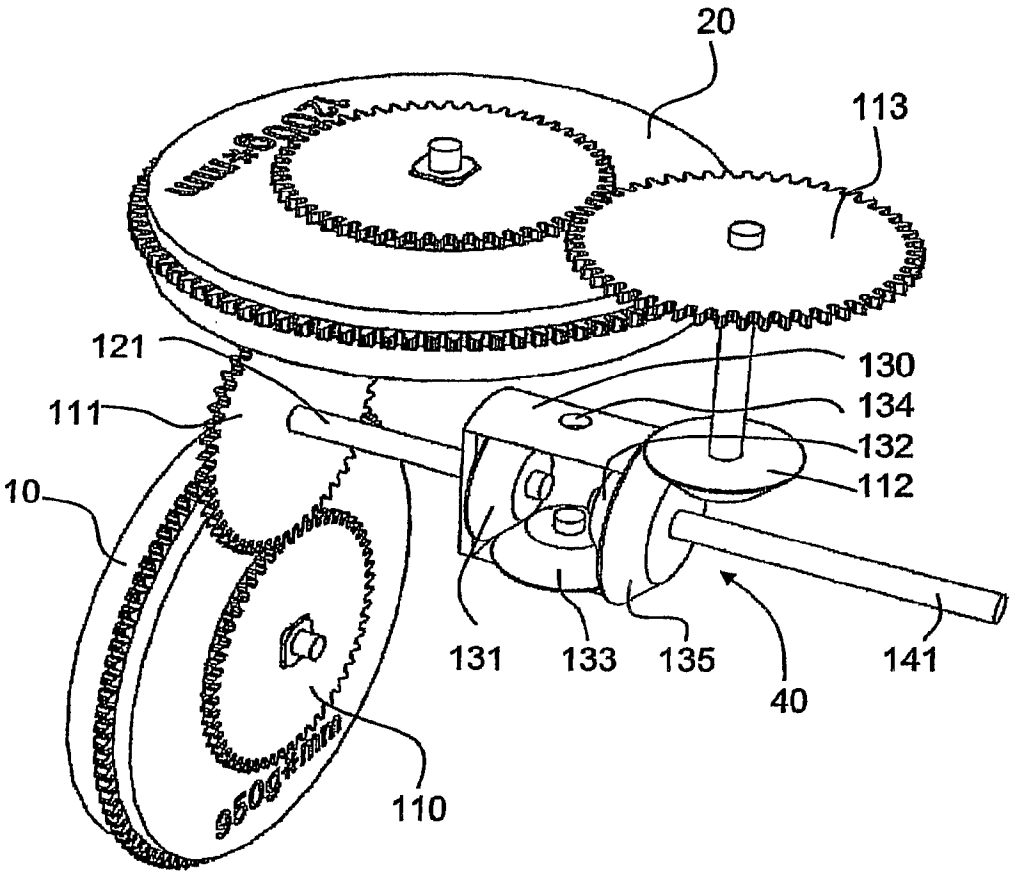
FIG. 1 shows a basic, schematic representation of the essential components of a watch of this type according to a first exemplary embodiment.

FIG. 1 shows a basic, schematic representation of the essential components of a watch of this type according to a first exemplary embodiment.

The reference 10 is given in a general manner to the spring barrel of the motive spring, which is secured in the interior of the first spring barrel 10 according to the knowledge of the person skilled in the art. The spring barrel 10, referred to below as the first spring barrel, comprises on the outside a spring barrel 12 with gear teeth as the unwind wheel and the spring, not represented in the figures, that is mounted on the inside in the first spring barrel on the spring securement 173, represented in FIG. 4. The spring can be designed, for example, as a spring with 950 g*mm. Via the gear teeth 110 and 111, it is connected to an axle 121, on which a schematically represented bevel gear 131 is secured. The axle 121 is mounted in a self-locking differential housing 130 of a differential 40. An axle 141 is located in alignment with respect to the axle 121 and is also mounted in the housing 130. A bevel gear 132 is located in the housing 130 connected to the axle 141, said bevel gear, as the bevel gear 131, being in engagement with a differential bevel gear 133. The differential bevel gear is mounted with its axle in the housing 130. In principle, it is also possible to provide another bevel gear for engagement with the bevel gears 131 and 132 at the opening given the reference 134.

The housing or differential basket 130 is fixedly connected to a bevel gear 135, which is in operative connection with a second spring barrel 20 by means of gear teeth 112 and 113.

The unit, comprising bevel gears 131, 132, 133 and housing 130 can be identified as differential 40 with bevel gears. It has a gear ratio of 1:1 with reference to the torque distribution. A differential 40 is, in principle, a special planetary gear set where sun gear and ring gear are the same size.

The axle 141 is connected to the conventional, known automatic winding means. It is also possible for the manual winding means to engage here. When said winding means operates, the axle 141 rotates and transfers the torque evenly to the two spring barrels 10 and 20. If the wearer of the watch with automatic winding does not move, the axle 141 is stationary and locks. This means gear 132 does not move and an unwinding of bevel gear 131 results in an identical unwinding of bevel gear 133, such that the housing 130 rotates in the opposite direction and its movement is transferred via the gear wheel 135 to the second spring barrel 20 to the effect that the spring located therein, and not represented in the drawings, also relaxes. The second spring barrel 20 has a higher torque and is designed, for example, with 1200 g*mm.

The differential 40 represented has a so-called stationary gear ratio of −1. In the case of other exemplary embodiments of the invention the differential 40 can also be developed as a planetary gear set with a stationary gear ratio not equal to −1. This can be achieved by the ring and sun gears (which correspond to bevel gears 131 and 132) being different sizes, for example the bevel gear or gears 133/134 would then be inclined relative to the small wheel 131/132 with their axle in the housing 30. It is also possible to use other gear sets such as spur gear differentials.

Figure 2:
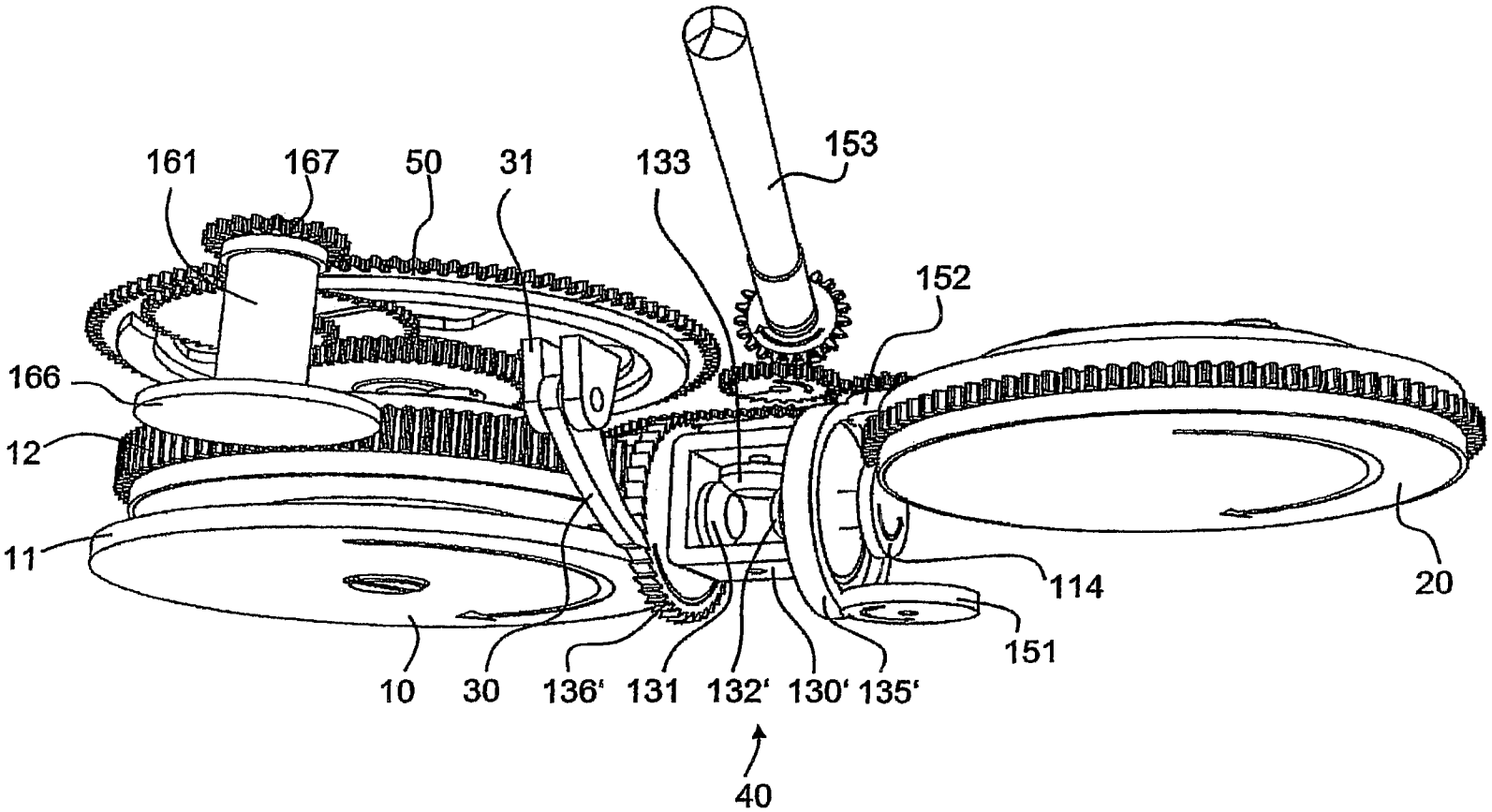
FIG. 2 shows a basic, schematic representation of essential components of a watch of this type according to a second exemplary embodiment.

FIG. 2 shows a basic, schematic representation of essential components of a watch of this type with a differential 40 according to a second exemplary embodiment. Identical functional components have identical references, similar ones have the reference followed by an apostrophe.

The differential basket 130' comprises, once again, the bevel gears 131 and 133, the bevel gear 131 engaging in the ratchet wheel 11 of the first spring barrel 10 via a gear wheel (not represented in FIG. 2) on the axle 121.

Differing from the concept of the exemplary embodiment in FIG. 1, it is the axle 141' on which the bevel gear 132' of the housing 130' is secured. Said bevel gear, in this case, is connected to the second spring barrel 20 by means of a gear wheel 114.

The gear wheel 135' of the housing 130' of the differential is now in engagement with the gear wheel 151 of the automatic winding means and, preferably at the oppositely situated end with parallel axis, with the first gear wheel 152 of the manual winding means, the winding axle of which is given the reference 153.

It is essential to mention the pawl 30 in FIG. 2, the free end of which engages in the ratchet wheel 136', which is fixedly connected to the housing 130'. The pawl 30 is preferably secured by way of its base 31 on a base plate that is not represented in FIG. 2 for reasons of clarity, the spring barrels 10 and 20 also being located on said base plate.

If the manual winding means is now rotated by way of its axle 153 corresponding to the arrow represented, the housing 130' can begin to rotate. The same applies when the gear wheel 151 is rotated by means of the automatic winding means, as it were as last member, in the direction represented by the arrow.

Consequently, corresponding to its development, the differential 40 transfers the torque on both sides to the spring barrels 10 and 20. The gear wheel 133 is rotated in FIG. 2 forwards out of the image plane and entrains the bevel gears 131 and 132' in a corresponding manner in order to achieve the movement corresponding to the arrows on the spring barrels. The two spring barrels 10 and 20 are wound-on.

The pawl 30 only allows the differential housing 130' to rotate in one direction. The housing 130' stops, in particular, if the winding means by means of the elements 151 and 153 stop. Rotation in the opposite direction is prevented. If the spring barrel 20 unwinds, that is a rotation of the spring barrel 20 in opposition to the direction indicated by way of the arrow shown, the gear wheel 114 rotates in the opposite direction to the one shown and, with the housing 130' stopped, the movement is transferred in the manner represented onto the spring barrel 10. The pawl 30 prevents the housing 130' from being entrained. This means that the first spring barrel 10 is now wound on by the unwinding of the second spring barrel 20. This is possible because the second spring barrel 20 is designed to be stronger (for example 1200 g*mm) than the first spring barrel 10 (in this case, for example, 950 g*mm). The direction represented by way of the arrow on the spring barrels 10 and 20 corresponds in each case to the winding direction of the spring barrels 10 and 20.

The ratchet wheel 11 interacts in a known manner with the other components of the spring barrel 10. In particular, it is connected by way of the square end or lock bolt 171 to the shaft 172. In this respect, the first spring barrel 10 is wound up in an indirect manner, the second spring barrel 20, contrary to this, in a direct manner.

The identical method of operation is produced in the embodiment in FIG. 1. In this respect, it is through a differential transfer comprising three trains, where the stationary gear ratio between first and second spring barrel 10 and 20 is negative (less than zero), that in the case of a winding action, irrespective of whether it operates automatically or manually, both spring barrels 10 and 20 are wound on, whereas if the winding means stops the stronger second spring barrel 20 continues to wind on the weaker first spring barrel 10 and consequently said first spring barrel, along with a longer lifetime, has a constant force as it is not released from a wound state as long as the second spring barrel has reserve energy. The term reserve energy refers to the amount of energy of the second spring barrel 20 by which it exceeds the standard energy of the first spring barrel 10. In other words, if the standard energy of the first spring barrel 10 is selected, for example, at 1000 g*mm and the constant force can be maintained for as long as the second spring barrel with an initial design of 1200 g*mm remains in excess of the said 1000 g*mm. In addition, a longer lifetime is achieved in that in the event of a theoretical drop in the energy of the first spring barrel 10 to 900 g*mm, with the second spring barrel 20 still at 1000 g*mm, by means of the compensation via the differential 40, the first spring barrel 10 actually remains at 950 g*mm such that in addition the lifetime is lengthened. However, the constant force, which alone brings about one advantageous development of the watch according to the invention, is not the only effect according to the invention. A second advantage is that in a further development, the disadvantages that arise in the case of a spring barrel provided with a slip clutch are avoided.

A sun gear is given the reference 50 in FIG. 2, said sun gear being connected to the unwind wheel 12 of the spring barrel 10 by means of a column wheel or drive wheel 161. Said sun gear is now explained with a device limiting the torque in conjunction with FIGS. 3 and 4.

Figure 3:
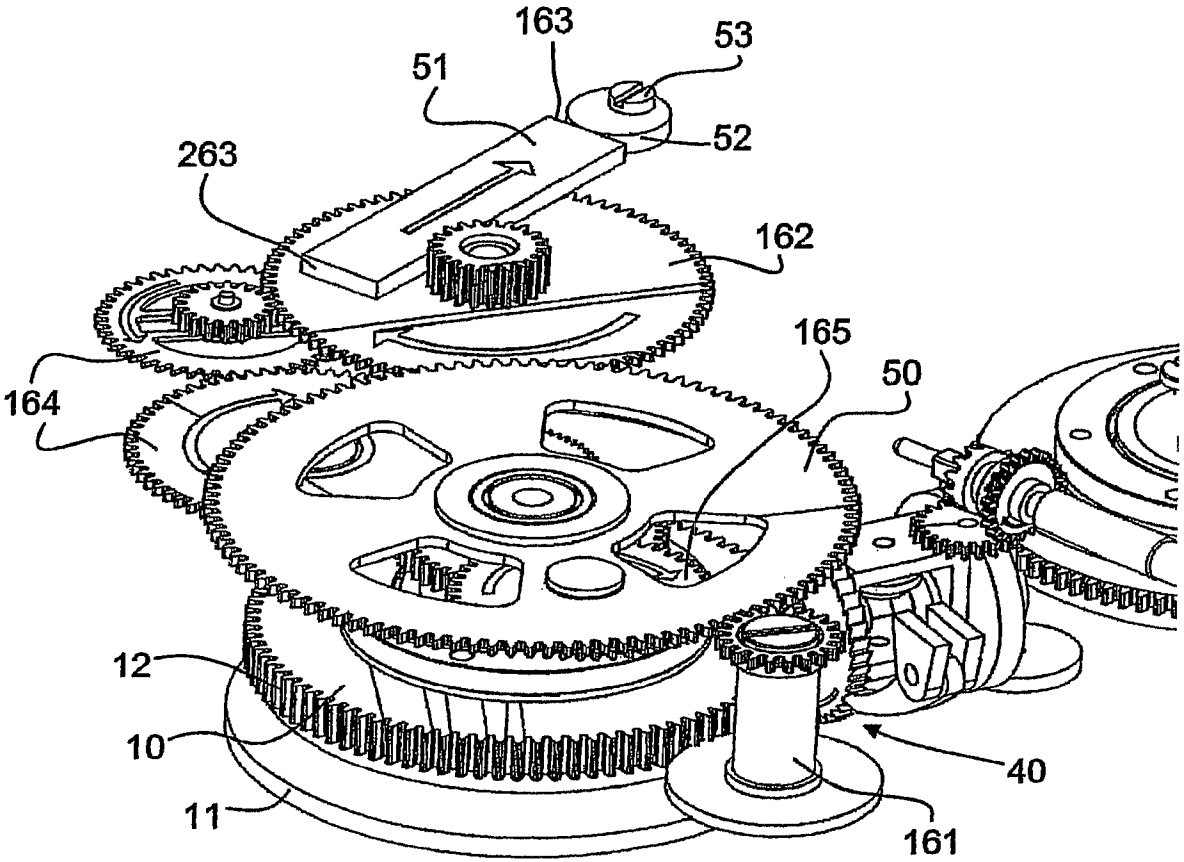
FIG. 3 shows a schematic view of a device for torque limiting with a central sun gear.

FIG. 3 shows a schematic view of the device for limiting torque with the central sun gear 50. Said sun gear is connected to a column wheel or drive wheel 161 by means of a known sequence of reduction gears 164, said column wheel or drive wheel driving a rack 51, which has a front stop face 163 which, after corresponding movement in the direction of the arrow, impacts against a torque screw 52. The torque screw 52 is secured to a base plate of the watch by means of an adjusting screw 53. The torque screw 52 is advantageously an eccentric screw so that by rotating the same about the axis of the adjusting screw 53, the end position of the rack 51 is adjustable, at which said rack impacts against the torque screw 52 by way of the limiting face 163.

Figure 4:
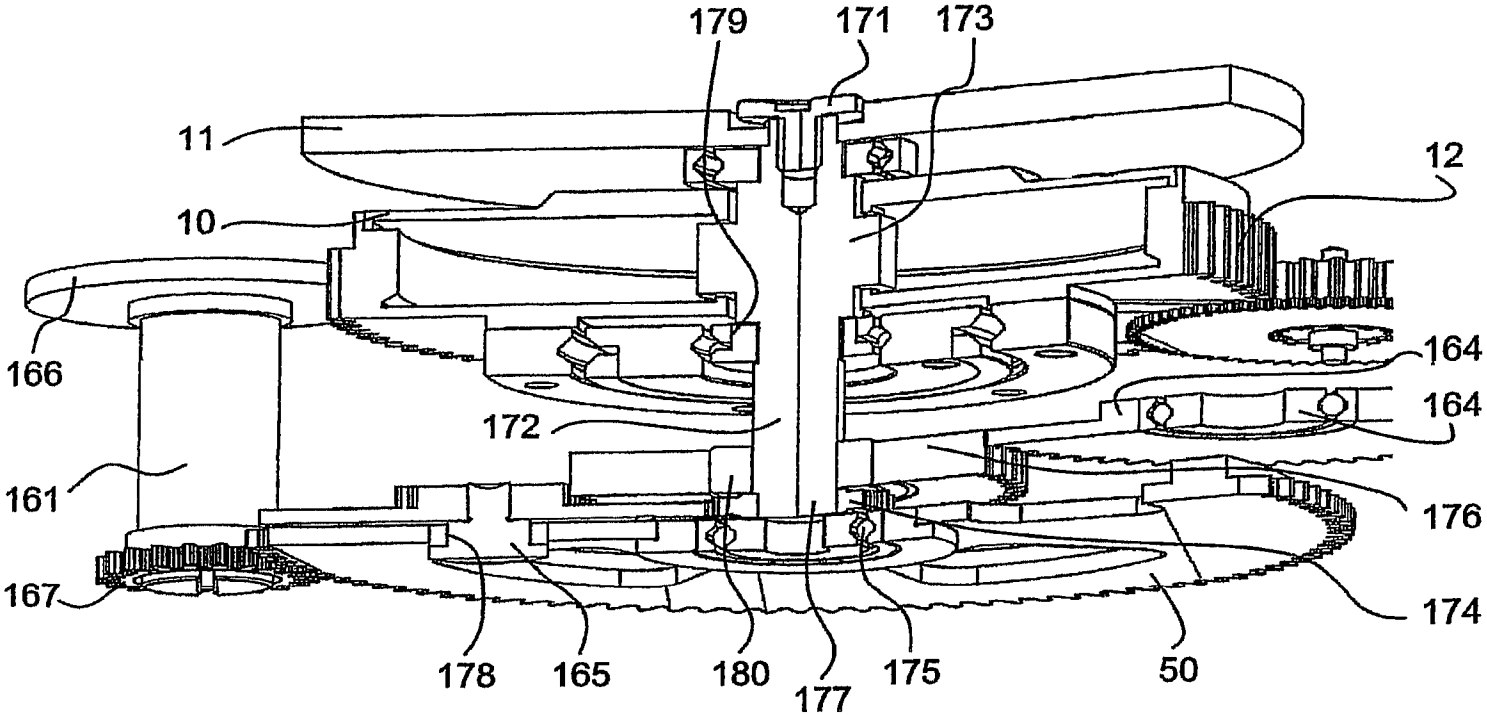
FIG. 4 shows a schematic, partially sectional view of the design of the sun gear construction interacting with the first spring barrel.

FIG. 4 shows in a schematic, partially sectional manner the design of the sun gear construction interacting with the first spring barrel 10. This design can be used for both exemplary embodiments in FIGS. 1 and 2 and also in further embodiments not represented in the figures.

The column wheel 161 has a gear wheel at each of its two ends: the sprocket 166 for coupling with the wind wheel 12 of the first spring barrel 10 and the sprocket 167 for coupling with the sun gear 50.

The ratchet wheel 11 is rigidly connected to the shaft 172 by means of a square end 171 acting as a locking bolt. The shaft 172 is passed through the spring barrel 10 and is there for the spring securement 173 in the first spring barrel 10. At its oppositely situated end it is mounted on a ball bearing arrangement 179, which in this case is realized as a double ball bearing arrangement. The ball bearing arrangement 179 is connected to the first spring barrel 10.

A rotation of the shaft 173 in one direction, with the spring barrel 10 stopped, that means the housing with the unwind wheel 12, leads to the spring located therein being wound on. A rotation of the spring barrel 10 in the identical direction (with the shaft 173 stopped) releases the spring. This is essential to the operation of the engagement between planetary gear 165 and sun gear 50. The sun gear 50 is rotated with the spring barrel 10 rotating in the identical direction. The shaft 172 transfers its rotary movement onto the larger of the gear teeth of the planetary gear 165 by means of the small transfer gear 174, which is fixedly connected to the shaft 172 via the square end 177. Said planetary gear then rotates the sun gear 50 in the opposite direction. Consequently, a rotation of the ratchet wheel 11 to wind on the spring barrel 10 results in a rotation of the sun gear 50 in the one direction. The unwinding of the unwind wheel 10, contrary to this, leads to a rotation of the sun gear 50 in the other direction. In other words, winding on the spring barrel 10 within the scope of its unwinding results in stopping the sun gear 50. The person skilled in the art knows that providing the rack 51 with additional gear wheels 164 corresponds to a watch unwinding indicator. To this end, the planetary gear 165 is provided with an additional smaller toothing, which engages in the transfer gear wheel 176 of the planetary wheel 165 associated with said toothing. Said transfer gear wheel 176 then engages in the first of the gear wheels 164. The transfer gear wheel 176 can be mounted on the shaft 172 in particular by way of a "jewel" bearing 180, which is practical for reasons of space. However, it is not mounted necessarily concentrically with the axis of the shaft 172. In this respect, the average gear wheel structure is known to the person skilled in the art. However, for the purposes of the present invention, he has to provide the face 163, which limits the movement of the rack 51 at the stop face 163 of the torque screw 52. It will be shown below that said stop member serves the torque limiting means in its value upwards.

Figure 5:
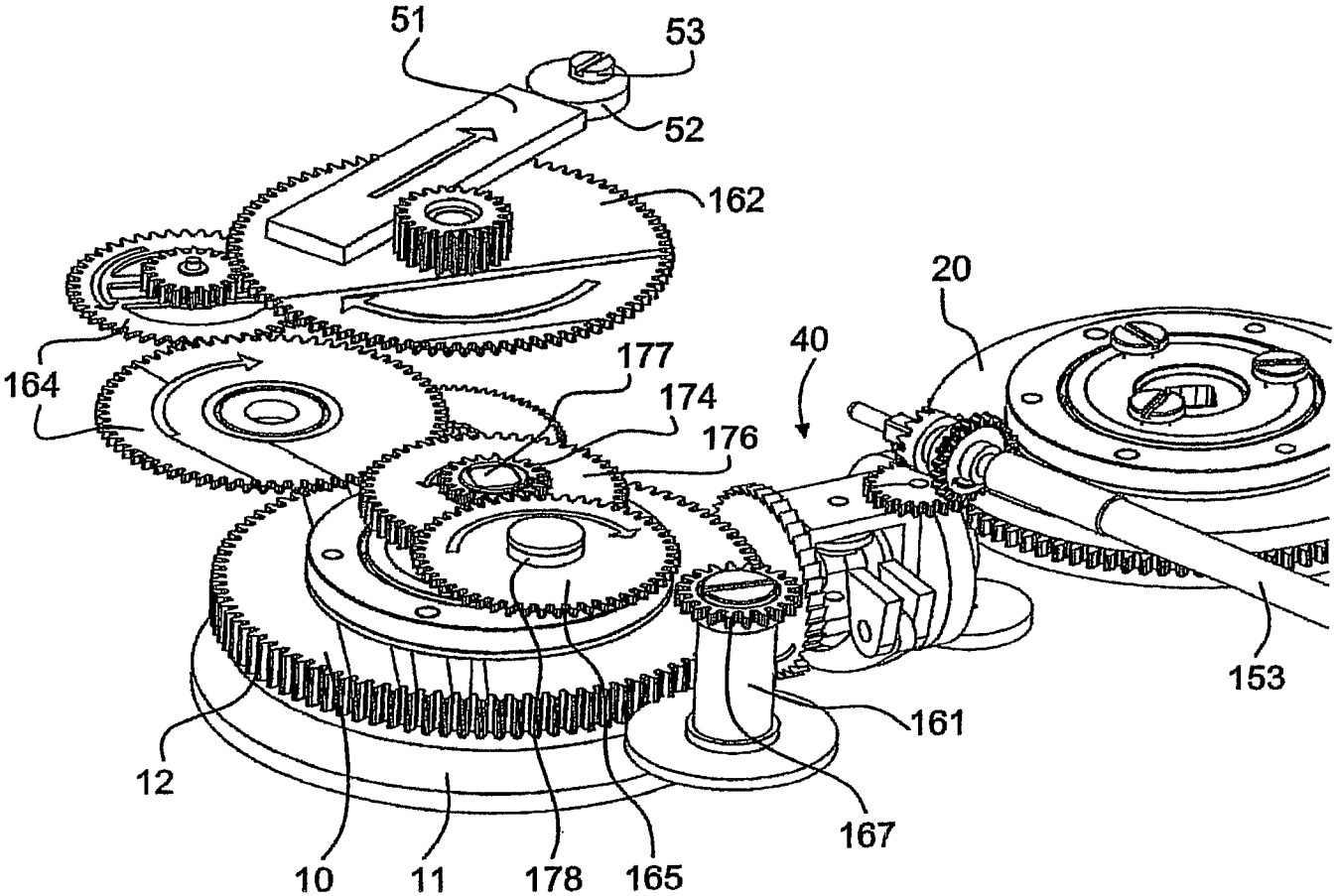
FIG. 5 shows a schematic view similar to FIG. 3 with no sun gear represented.

FIG. 5 shows a schematic view similar to FIG. 3 with no representation of the sun gear 50, which is mounted concentrically to the central axis of the shaft 172 indicated by the square end 177 and is in operative connection with the components represented in FIG. 5 by means of an outer engagement in the wheel 167 and by means of the bearing 178 of the planetary wheel 165.

Previously, reference has been made to another embodiment that has not been not represented in the drawings, where a second torque screw is provided on the oppositely situated side of the rack 51. A stop face is provided in this case in an analogous manner and is drawn in as a concept in FIG. 3 for clarification purposes and is given the reference 263. In this case, said stop face limits the torque in its value downwards.

The operation of the torque limiting means upwards is now as follows. The ratchet wheel 11 is rotated by means of the winding means that acts on the housing 130 and winds on the spring in the interior of the spring barrel 10. It additionally rotates the planetary gear 165 in the direction marked in FIG. 3, such that the sun gear 50 and the gear wheels 164 connected downstream rotate corresponding to the arrows shown. Consequently, the rack 151 is advanced against the torque screw 52. When reaching the stop face 163 of the same, the device locks and the ratchet wheel is no longer able to rotate; the spring barrel 10 is wound on. If the unwinding of the unwind wheel 12 of the spring barrel 10 is identical in size to the re-tensioning by way of the ratchet wheel 11, the person skilled in the art knows immediately that the torque created and applied by the spring is uniform and constant. There is no reduction.

Through the locking of the ratchet wheel 11 by means of the described force transfer chain proceeding from the rack 51, further winding action is now passed on in another way by means of the differential 40. As the bevel gear 131 is blocked, the rotating of the axle 153 or of the gear wheel 151 leads to a rotating of the gear wheel 132' (in the exemplary embodiment in FIG. 1 this would be the axle 141) and consequently to a winding on of the second spring barrel 20. In this case it is possible for the slip clutch provided in the interior of the spring barrel 20 to respond and consequently slip through. However, this only has one effect on the moving train, that is to say the reliably produced torque fluctuation that acts on the bevel gear 132' is essentially passed on to the winding parts 151 and 153. Transferring this fluctuation to the spring barrel 10 is extensively avoided.

Tests have shown that in this context the design in FIG. 2, with the effect of the slip clutch on the axle 141 and consequently on the bevel gear 132', is more advantageous than the effect of this type of impact on the housing 130 of the differential 40 by means of the bevel gear 135.

If no winding occurs, energy is transferred to the first weaker spring barrel 10 for a certain period of time by means of the second stronger spring barrel 20, such that the force exerted in this case by the spring remains completely constant over a longer period, as long as the excessive energy existing through the second spring barrel 20 is in excess of the design of the first spring barrel 10, that is to say, for example, in excess of 950 g*mm.

If now both spring barrels 10 and 20 unwind, the rack 51 moves back until, in the exemplary embodiment not shown, it impacts by way of the face 263 against a second torque screw. Consequently, the movement of the unwind wheel 12 responsible for the backward movement is blocked and the watch stops. At first sight this appears to be a disadvantage. However, it is an advantage, because, in particular in the case of an automatic winder, the watch operating for a longer time in a regime that is unfavorable to the accuracy is avoided, in other words when the watch is running it is running with greater accuracy. A watch unwinding indicator can also be derived directly from the movement of the rack 51, where 'maximum' indicates the constancy of the spring force driving the watch and the indicator approaching a 'minimum' position suggests winding on.

It is clear that the person skilled in the art envisages other different realizations. Thus different differentials 40 have already been described. Any other differentials can also be used, insofar as the winding train 141, 151, 152 acts on the first and second spring barrel 10 and 20 in the same direction, and stopping of the same allows a reversed opposite unwinding in terms of the direction of rotation of spring barrel 10 and 20, the stronger spring barrel 20 advantageously having a device for preventing the over tensioning of its spring, whilst the weaker spring barrel 10 actually drives the watch. In an advantageous manner, in this case, a torque limiting means at least upwards is provided, which makes a maximum position for the winding of the first spring barrel 10 adjustable by means of a torque limiting means and in a further development guarantees the unwinding of the spring of the spring barrel 10 with minimum tension. The conveying element, in this case a rack 51, can also be developed in another manner, for example by a gear wheel, which has a radially outwardly pointing indicator, which can impact against maximum and/or minimum stop members likewise located radially relative to said gear wheel. In this case, an angular movement of said indicator is provided in place of the linear movement of the rack 51.

The spring barrel 10 is a spring barrel with a spring, which is fixedly secured to the inner edge of the spring barrel and to the shaft 173 of the axle 172 of the ratchet wheel 11.

The spring barrel 20 is a spring barrel 20 limited in its winding of the spring by means of a slip clutch or another known means.

LIST OF REFERENCES

10 First spring barrel with motive spring
11 Ratchet wheel
12 Unwind wheel
20 Second spring barrel with brake spring
30 Pawl
40 Differential
50 Sun gear
51 Rack
52 Torque screw
53 Adjusting screw
111 Gear wheel
112 Gear wheel
113 Gear wheel
114 Gear wheel
121 Axle for connecting first spring barrel
130 Housing of the differential of the train of the second spring barrel
130' Housing of the differential of the train of the winding means
131 Bevel gear of the differential of the train of the first spring barrel
132 Bevel gear of the differential of the train of the winding means
132' Bevel gear of the differential of the train of the second spring barrel
133 Bevel gear of the differential
134 Bearing arrangement of another bevel gear of the differential
135 Gear wheel of the housing of the differential
135' Gear wheel of the housing of the differential
136' Ratchet gear wheel
141 Axle for connecting to the drive
151 Gear wheel of the automatic winding means
152 First gear wheel of the manual winding means
153 Winding axle of the manual winding means
161 Column wheel
163 Limiting face
164 Further gear wheels
165 Planetary wheel
166 Sprocket with the running wheel of the first spring barrel
167 Sprocket with the sun gear
171 Square end as locking bolt
172 Shaft
173 Spring securement in the first spring barrel
174 Transfer gear wheel
175 Ball bearing arrangement of the sun gear
176 Transfer gear wheel of the planetary wheel
177 Square end
178 Bearing arrangement of the planetary wheel
179 Ball bearing
180 Jewel bearing

The invention claimed is:

1. A mechanical wristwatch comprising:
a winding device;
a first spring barrel;
a second spring barrel;
a motive spring in the first spring barrel; and
a differential comprising three drive trains wherein at least one drive train is connected to the winding device;
wherein the drive train connected to the winding device acts on the first and the second spring barrel in the same direction,
wherein, if the train connected to the winding device stops, an unwinding of the first spring barrel is compensable by an application of energy from the second spring barrel via the differential, and
wherein the second spring barrel is designed to be stronger than the first spring barrel.

2. The mechanical wristwatch as claimed in claim 1, wherein the winding device is a mechanical or automatic winding device.

3. The mechanical wristwatch as claimed in claim 1, wherein the differential is a spur wheel differential.

4. A mechanical wristwatch comprising:
a first winding device;
a first spring barrel;
a second spring barrel;
a motive spring in the first spring barrel; and
a differential comprising three drive trains wherein at least one drive train is connected to the winding device;
wherein the drive train connected to the winding device acts on the first and the second spring barrel in the same direction, and
wherein the first spring barrel includes an unwind wheel and a second winding device, wherein the unwind wheel and the second winding device are in operative connection with a torque limiting device, such that when a predetermined maximum tension of the motive spring in the first spring barrel is reached further winding-on is avoided such that the first winding device acts exclusively on the second spring barrel by means of the differential.

5. The mechanical wristwatch as claimed in claim 4, wherein the first spring barrel includes an unwind device and the unwind wheel and the winding device of the first spring barrel are in operative connection with a sun gear and a planetary gear connected to said sun gear, by means of which a limiting element is moveable against a stop member.

6. The mechanical wristwatch as claimed in claim 5, wherein the limiting device is a rack and wherein the stop member is a torque screw.

7. The mechanical wristwatch as claimed in claim 5, wherein the limiting device is a radial pointer of a gear wheel, and wherein the stop member is a stop member limiting the angular movement of the radial pointer.

8. The mechanical wristwatch as claimed in claim 4, wherein the first winding device is a mechanical or automatic winding device.

9. The mechanical wristwatch as claimed in claim 4, wherein the differential is a spur wheel differential.

10. A mechanical wristwatch comprising:

a first winding device;

a first spring barrel;

a second spring barrel;

a motive spring in the first spring barrel; and a differential comprising three drive trains wherein at least one drive train is connected to the winding device;

wherein the drive train connected to the winding device acts on the first and the second spring barrel in the same direction, and wherein the first spring barrel includes an unwind wheel and a second winding device, wherein the unwind wheel and the second winding device are in operative connection with a torque limiting device such that when a predetermined minimum tension of the motive spring of the first spring barrel is reached, further unwinding is avoided.

11. The mechanical wristwatch as claimed in claim 10, wherein the unwind wheel and the second winding device are in operative connection with a sun gear and a planetary gear that is connected to said sun gear, by means of which a limiting element is moveable against a stop member.

12. The mechanical wristwatch as claimed in claim 11, wherein the limiting device is a rack, and wherein the stop member is a torque screw.

13. The mechanical wristwatch as claimed in claim 12, wherein the stop member is an adjustable eccentric torque screw.

14. The mechanical wristwatch as claimed in claim 11, wherein the limiting device is a radial pointer of a gear wheel, and wherein the stop member is a stop member limiting the angular movement of the radial pointer.

15. The mechanical wristwatch as claimed in claim 10, wherein the first winding device is a mechanical or automatic winding device.

16. The mechanical wristwatch as claimed in claim 10, wherein the differential is a spur wheel differential.

17. A mechanical wristwatch comprising:

a winding device;

a first spring barrel;

a second spring barrel;

a motive spring in the first spring barrel; and a differential comprising three drive trains wherein at least one drive train is connected to the winding device;

wherein the drive train connected to the winding device acts on the first and the second spring barrel in the same direction, and wherein the differential has a stationary gear ratio between the first and second spring barrels of −1 and the second spring barrel is designed to be stronger than the first spring barrel.

18. A mechanical wristwatch comprising:

a winding device;

a first spring barrel;

a second spring barrel;

a motive spring in the first spring barrel; and a differential comprising three drive trains wherein at least one drive train is connected to the winding device;

wherein the drive train connected to the winding device acts on the first and the second spring barrel in the same direction, and wherein the differential is a planetary gear set with different sized ring and sun gears and at least one bevel wheel, wherein the at least one bevel wheel is inclined towards a smaller of the different sized ring and sun gears, the axis of the at least one bevel wheel being in the differential housing.

19. The mechanical wristwatch as claimed in claim 18, wherein the winding device is a mechanical or automatic winding device.

20. The mechanical wristwatch as claimed in claim 18, wherein the differential is a spur wheel differential.

* * * * *

UNITED STATES PATENT AND TRADEMARK OFFICE

CERTIFICATE OF CORRECTION

PATENT NO. : 8,550,701 B2
APPLICATION NO. : 12/741506
DATED : October 8, 2013
INVENTOR(S) : Kury et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 741 days.

Signed and Sealed this
Fifteenth Day of September, 2015

Michelle K. Lee

Michelle K. Lee
*Director of the United States Patent and Trademark Office*